US010190397B2

(12) United States Patent
Budde et al.

(10) Patent No.: US 10,190,397 B2
(45) Date of Patent: Jan. 29, 2019

(54) CLOSURE DEVICE FOR A SURGE PRESSURE REDUCTION TOOL

(71) Applicant: Weatherford Technology Holdings, LLC, Houston, TX (US)

(72) Inventors: Marcel Budde, Vlaardingen (NL); Mark Baas, Schiedam (NL); Norman Vladimir Parra Mayorga, Vlaardingen (NL)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 243 days.

(21) Appl. No.: 14/710,285

(22) Filed: May 12, 2015

(65) Prior Publication Data

US 2015/0330186 A1 Nov. 19, 2015

Related U.S. Application Data

(60) Provisional application No. 61/992,820, filed on May 13, 2014.

(51) Int. Cl.

| | |
|---|---|
| ***E21B 43/10*** | (2006.01) |
| ***E21B 34/14*** | (2006.01) |
| ***E21B 34/06*** | (2006.01) |
| ***E21B 34/12*** | (2006.01) |
| ***E21B 34/00*** | (2006.01) |

(52) U.S. Cl.

CPC ..... *E21B 43/10* (2013.01); *E21B 34/063* (2013.01); *E21B 34/12* (2013.01); *E21B 34/14* (2013.01); *E21B 2034/007* (2013.01)

(58) Field of Classification Search

CPC ..... E21B 43/10; E21B 34/00; E21B 34/063; E21B 34/06; E21B 34/12; E21B 34/14; E21B 2034/007

See application file for complete search history.

(56) References Cited

U.S. PATENT DOCUMENTS

| | | | | |
|---|---|---|---|---|
| 5,553,667 | A | 9/1996 | Budde et al. | |
| 5,787,979 | A | 8/1998 | Giroux et al. | |
| 5,813,457 | A | 9/1998 | Giroux et al. | |
| 6,009,944 | A | 1/2000 | Gudmestad | |
| 6,079,496 | A * | 6/2000 | Hirth | E21B 34/14 166/321 |
| 6,244,350 | B1 | 6/2001 | Gudmestad et al. | |
| 6,311,771 | B1 | 11/2001 | Gudmestad et al. | |
| 6,419,015 | B1 | 7/2002 | Budde et al. | |
| 6,799,638 | B2 | 10/2004 | Butterfield, Jr. | |
| 6,802,372 | B2 | 10/2004 | Budde | |
| 7,069,992 | B2 | 7/2006 | Lewis et al. | |
| 7,182,135 | B2 | 2/2007 | Szarka | |

(Continued)

OTHER PUBLICATIONS

UK Combined Search and Examination Report dated Jul. 27, 2015, for UK Application No. GB1508108.6.

(Continued)

*Primary Examiner* — Taras P Bemko
*Assistant Examiner* — Jonathan Malikasim
(74) *Attorney, Agent, or Firm* — Patterson + Sheridan, LLP

(57) ABSTRACT

A closure device is provided to close a surge pressure reduction tool disposed in a deviated wellbore. The closure device may include a tubular body, a fin, and a rupture disk disposed in the tubular body. The closure device may be pumped downhole to close the tool.

25 Claims, 6 Drawing Sheets

(56) References Cited

U.S. PATENT DOCUMENTS

| | | | | |
|---|---|---|---|---|
| 7,909,108 | B2 * | 3/2011 | Swor | E21B 43/14 166/383 |
| 8,327,937 | B2 | 12/2012 | Giem et al. | |
| 8,789,582 | B2 | 7/2014 | Rondeau et al. | |
| 2005/0103493 | A1 | 5/2005 | Stevens et al. | |
| 2005/0211446 | A1 | 9/2005 | Ricalton et al. | |
| 2006/0011354 | A1 * | 1/2006 | Logiudice | E21B 21/103 166/380 |
| 2009/0056952 | A1 | 3/2009 | Churchill | |
| 2011/0284224 | A1 | 11/2011 | Misselbrook et al. | |
| 2012/0125629 | A1 * | 5/2012 | Churchill | E21B 21/103 166/373 |
| 2012/0234561 | A1 | 9/2012 | Hall et al. | |
| 2013/0068451 | A1 * | 3/2013 | Getzlaf | E21B 23/02 166/250.07 |
| 2013/0112410 | A1 | 5/2013 | Szarka et al. | |
| 2014/0008055 | A1 * | 1/2014 | Allamon | E21B 34/14 166/194 |
| 2014/0034310 | A1 | 2/2014 | Andersen | |

OTHER PUBLICATIONS

Canadian Office Action dated Mar. 7, 2016, for Canadian Patent Application No. 2,891,003.

* cited by examiner

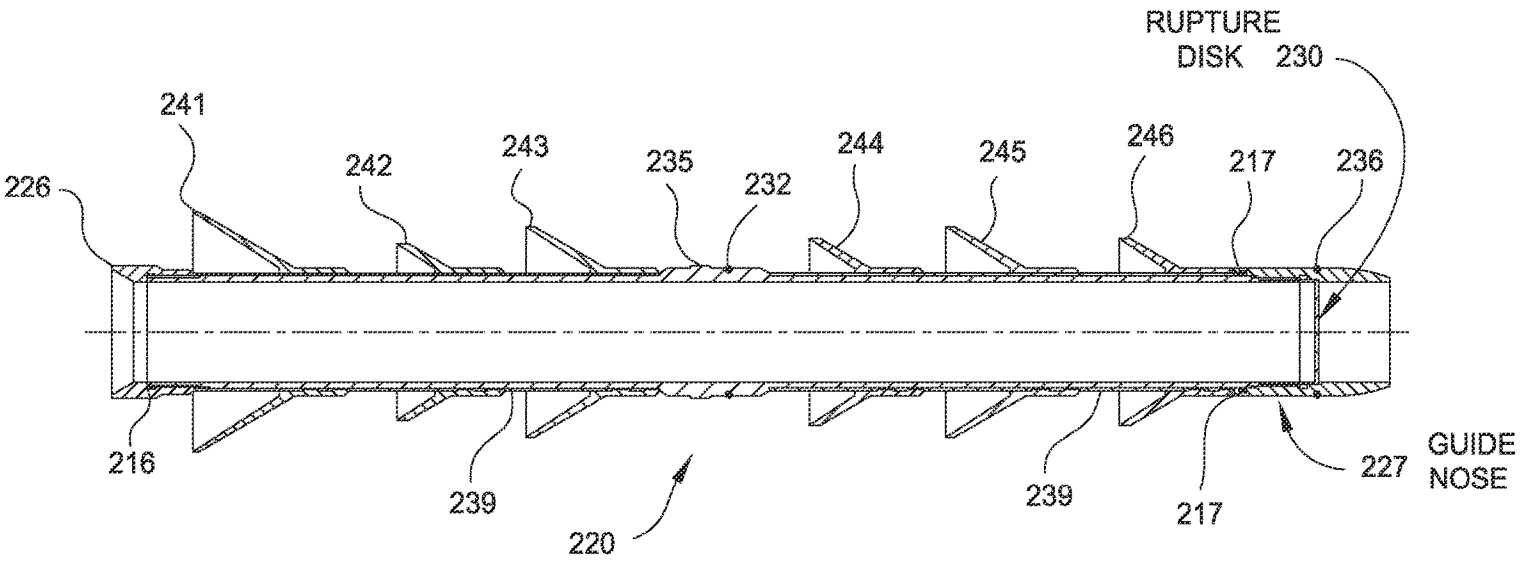
FIG. 7
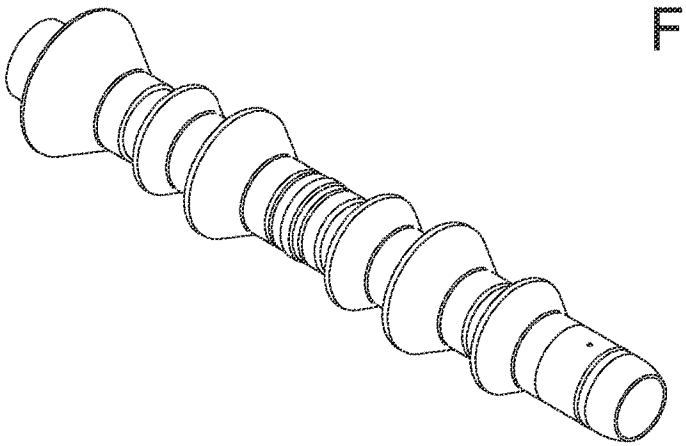

CLOSURE DEVICE FOR A SURGE PRESSURE REDUCTION TOOL

FIELD OF THE INVENTION

Embodiments of the present invention generally relate to running casing into a wellbore. More particularly, embodiments of the present invention relate to managing surge pressure while running casing into the wellbore. More particularly still, embodiments of the present invention relate to apparatus and methods of operating a surge pressure reduction tool.

DESCRIPTION OF THE RELATED ART

To obtain hydrocarbon fluid production from the earth, a wellbore is drilled from the surface using a drill string. After making the hole in the earth, a first section or string of casing is set in the drilled-out wellbore. The wellbore is extended by drilling further and lining the newly drilled section with additional casing. This process is repeated as desired to place casings within the wellbore to form a cased wellbore of desired depth.

After reaching the desired depth, it is often necessary or desirable to run wellbore tools into the casing. Also, hydrocarbon fluid may migrate through the inner diameter of the casing to the surface of the wellbore. To allow for the maximum area for fluid flow during hydrocarbon production as well as to permit maximum clearance for wellbore tools through the cased wellbore, it is desirable that the cased wellbore possess the largest inner diameter possible for its depth; therefore, each subsequently-run casing usually has only a slightly smaller outer diameter than the inner diameter of the previously-run casing.

Because of the small variance between the outer diameter of the subsequently-run casing and the inner diameter of the previously-run casing, only a small annular clearance between casings may exist during run-in of the subsequent casing. The small clearance between the casings causes a large amount of surge pressure to be imparted on the formation below the previously-run casing when the subsequently-run casing is lowered into the wellbore. Overpressurizing the formation can damage the formation, jeopardizing production of hydrocarbons.

Additionally, when running casing into the wellbore, fluid located within the wellbore tends to flow up through the inner diameter of the casing being run. The fluid flowing up the casings may relieve some of the pressure surge generated during run in. Because casings are typically run in on a smaller diameter running string, the smaller diameter running string further increases the pressure within the running string as the fluid flows upward. The pressure increase may create a surge that may cause the fluid from downhole to spill onto the rig floor, thereby making the rig floor slippery and a safety hazard.

To partially alleviate the surge problem, casings are often run into the wellbore at reduced speeds to decrease pressure on the fluid within the wellbore. Reducing the speed of running casings into the wellbore and cleaning up the rig floor increases the amount of time required to obtain a producing wellbore, thus increasing the cost of the wellbore.

A similar problem occurs when running casing into a wellbore formed in a delicate formation. Running casing into a delicate formation could easily result in damage to the formation due to high downhole pressure caused by running the casing into the wellbore.

To prevent the problems that occur due to small clearance in the annulus between casings and due to pressure on delicate formations, diverter tools have been developed to divert fluid into the wellbore annulus while running the casing into the wellbore. One proposed diverter tool includes ports within its tubular body for circulating fluid therethrough while running the casing into the wellbore. The ports are open while the casing is run into the wellbore and can only be closed once; therefore, this diverter tool is a one-shot tool. Generally, the diverter tool utilizes a hydrostatic pressure within a chamber to move a sleeve to close the ports when a predetermined tool depth is reached. However, the hydrostatic pressure changes as depth increases; therefore, this type of diverter tool may not operate correctly when the wellbore is not a vertical wellbore (e.g., a deviated, lateral, directional, or horizontal wellbore).

Furthermore, when running casing into the wellbore, fluid typically flows upward into the casing as the casing is run downhole. However, sometimes while running the casing into the wellbore, the casing reaches an obstruction which prevents the casing from running further into the wellbore. The obstruction is often easily removed by circulating fluid down through the casing and out into the wellbore to wash away the obstruction (which may be a portion of the formation). While the proposed diverter tool allows closure of the ports for possible circulation of fluid down through the casing to wash away an obstruction, the one-shot nature of the diverter tool does not allow fluid to flow out through the ports in the diverter tool again as the casing is lowered further into the wellbore subsequent to removal of the obstruction. Because the ports of the one-shot diverter tool cannot again be opened while the diverter tool is in the wellbore during the casing running operation, the possibility of formation damage is greatly increased. Consequently, casing running speeds are typically greatly decreased to attempt to minimize formation damage and loss of expensive drilling fluids. If the ports of the diverter tool must be re-opened to further run the casing into the wellbore, the running string must be removed from the wellbore and then again run into the wellbore. Multiple run-ins of the casing and servicing of the diverter tool after its removal from the wellbore add time and thus cost to the formation of the wellbore.

Thus, there is a need for a diverter tool having one or more ports which may be opened or closed multiple times without user intervention or action beyond typical casing running operations. There is yet a further need for a diverter tool which may be deactivated by an event produced by procedures or tools commonly utilized when running casing into the wellbore. There is a further need for a diverter tool having a secondary backup closing apparatus or method.

SUMMARY OF THE INVENTION

In one embodiment, a closure device includes a tubular body having an enlarged outer portion and a bore therethrough; a first fin disposed around the tubular body; and a rupturable member disposed in the bore to block fluid communication. In another embodiment, the closure device includes a second fin having an outer diameter smaller than the first fin.

In another embodiment, a method of closing a tool in a wellbore includes releasing a closure device into the wellbore, wherein the closure device includes a fin; supplying fluid behind the closure device to move the closure device;

landing the closure device in a seat of the tool; moving a port sleeve coupled to the seat to close the tool; and decoupling the port sleeve from the seat.

In another embodiment, a method of closing a diverter tool in a wellbore includes releasing a closure device into the wellbore, wherein the closure device includes a fin; supplying fluid behind the closure device to urge the closure device downward; landing the closure device in the diverter tool; and closing the diverter tool. In yet another embodiment, the method includes opening fluid communication through the closure device.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 7 is a cross-sectional view of an exemplary embodiment of the closure device.

DETAILED DESCRIPTION OF THE PREFERRED EMBODIMENT

Embodiments of the present invention provide a diverter tool having a bypass valve for reducing surge pressure while running a tubular into the wellbore. The bypass valve is capable of automatically opening and closing multiple times while the tubular is run into the wellbore without user intervention or activation beyond typical tubular running procedures. This automatic opening and closing of the bypass valve allows the tubular to be run into the wellbore at an increased speed as compared to tubular strings which are run into the wellbore without diverter tools because the probability and magnitude of damage to the formation is decreased. The diverter tool operates without restricting the bore of the running string or the diverter, thereby allowing full access through the inner diameter of the diverter tool. Moreover, the diverter tool does not require dropping or pumping any device into the tool to operate the bypass valve during run-in of the tubular. Advantageously, the diverter tool provides an apparatus and method for reducing pressure on the formation and decreasing surge potential of fluid within the formation which is operable during the ordinary course of a tubular running operation without external devices, restricted bores, or the limitation of a one-shot tool.

Figure 1:
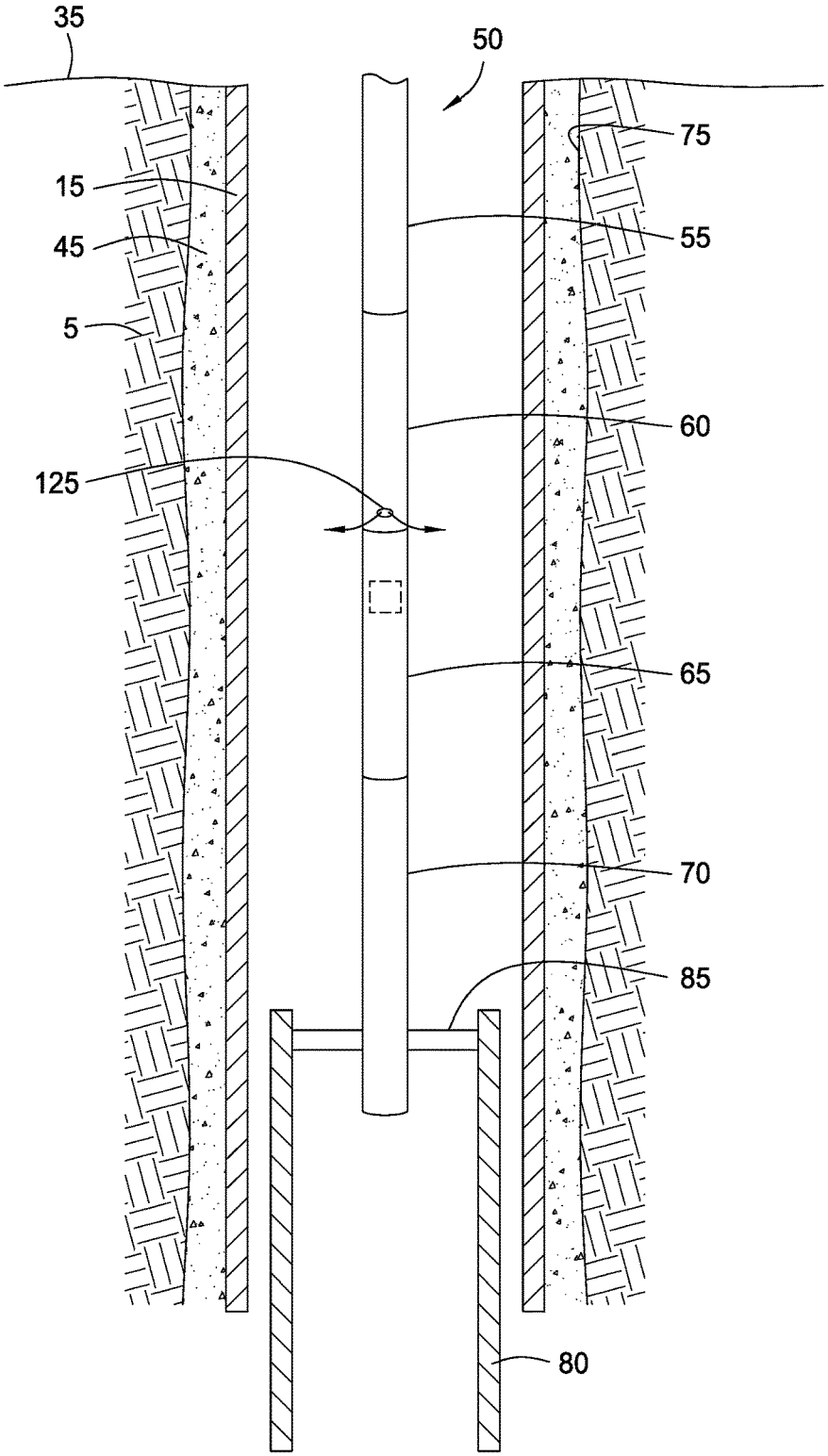
FIG. 1 is a cross-sectional view of casing attached to a running string having a diverter tool therein.

Shown in FIG. 1 is a running string 50 conveying casing 80 (the casing 80 may also be termed "liner") into a wellbore 75 formed in an earth formation 5. A portion of the wellbore 75 has casing 15 set therein by cement 45 or some other physically alterable bonding material within the annulus between the wall of the wellbore 75 and the outer diameter of the casing 15.

The running string 50 includes a running pipe 55, a diverter tool 60, a drill pipe 65, and a running tool 70. The running pipe 55 is used to lower the running string 50 from a surface 35 of the wellbore 75. A lower end of the running pipe 55 is connected to an upper end of the diverter tool 60, a lower end of the diverter tool 60 is connected to an upper end of the drill pipe 65, and an upper end of the running tool 70 is connected to a lower end of the drill pipe 65. In an alternate embodiment, the drill pipe 65 is not necessarily present between the diverter tool 60 and the running tool 70. In this instance, the lower end of the diverter tool 60 may be directly connected to the upper end of the running tool 70. The connections therebetween are preferably threadable connections, but may be any type of connections, direct or indirect, known by those skilled in the art. A substantially full bore runs through the length of the running string 50.

A lower portion of the running string 50 (specifically, the running tool 70) is releasably connected to an inner diameter of the casing 80 by a temporary attachment 85 such as a hanger. Fluid is flowable through the length of the bore of the running string 50 and through the casing 80.

FIGS. 2-6 show the diverter tool 60 in various positions, the operation of which is described below. The structural features of the diverter tool 60 are described in reference to all of FIGS. 2-6.

The diverter tool 60 includes a tool body 105 having a longitudinal bore therethrough. The body 105 includes an upper body 110 at its upper end, a lower body 120 at its lower end, and a port body 115 disposed between the upper and lower bodies 110, 120. The upper body 110 is connected to an upper end of the port body 115 by a threaded connection 112, while the lower body 120 is connected to a lower end of the port body 115 by a threaded connection 107. The connections are threaded for illustrative purposes only, as it is contemplated that other types of connections between tubular bodies which are known by those skilled in the art may be employed in embodiments of the present invention. The bodies 110, 115, 120 may also be only operatively connected to one another rather than directly connected. Moreover, although the tool body 105, as shown, includes three connected body portions 110, 115, 120 other embodiments of the present invention include one continuous tubular body, two separate bodies connected to one another, or greater than three separate bodies connected to one another. The upper body 110 is connected, preferably threadedly connected, to the lower end of the running pipe 55, while the lower body 120 is connected, preferably threadedly connected, to the upper end of the drill pipe 65 (see FIG. 1). In the alternate embodiment where the drill pipe 65 is not included within the running string 50, the lower body 110 is connected to the upper end of the running tool 70.

One or more sealing members 108 are disposed between the lower body 120 and port body 115, and one or more sealing members 111 are disposed between the upper body 110 and the port body 115. The sealing members 108, 111, which are preferably o-ring seals, provide a seal against fluid flow between the bore of the tool body 105 and the surrounding wellbore outside the tool body 105.

The upper end of the lower body 120 has a stop shoulder 127 formed a portion of the lower body 120 which extends into the bore of the diverter tool 60. The port body 115 also has an inwardly extending portion 126 which extends inward into the bore of the body 105 and includes an upper shoulder 129 and a lower shoulder 128.

Within the port body 115 are one or more sets of ports. The first set includes one or more bypass ports 125 which extend from the inner diameter of the port body 115 to the outer diameter of the port body 115 for allowing fluid flow therethrough from the bore of the diverter tool 60 to outside the diverter tool 60. In the embodiment shown, six bypass ports 125 are formed in the port body 115; however, any suitable number of bypass ports 125 is contemplated in embodiments of the present invention. Also disposed through the port body 115 are one or more pressure ports 130 for communicating the pressure within the wellbore to a select portion of the diverter tool 60 (described in detail below). Shown in the embodiment of FIGS. 2 and 2A are four pressure ports 130 through the port body 115, but any suitable number of pressure ports 130 may be located through the port body 115.

Located within the bore of the port body 115 is a flapper assembly 145 which is longitudinally slidable relative to the port body 115. The flapper assembly 145 includes a flapper body 140 having a flapper seat 146 on which a flapper 150 rests when closed. An exemplary flapper 150 is a curved flapper. The flapper 150 optionally includes a hole 151 selectively blocked by a rupture disk, a plug, or other suitable blocking devices. The blocking device may allow selective reverse circulation after cementing. The flapper body 140 includes one or more holes 157 extending therethrough to allow fluid such as mud flowing up from the wellbore during run-in of the casing 80 to pass the flapper assembly 145, thereby preventing collapse of the upper portion of the running string 50 due to lack of any fluid pressure in the upper portion.

Figure 2:
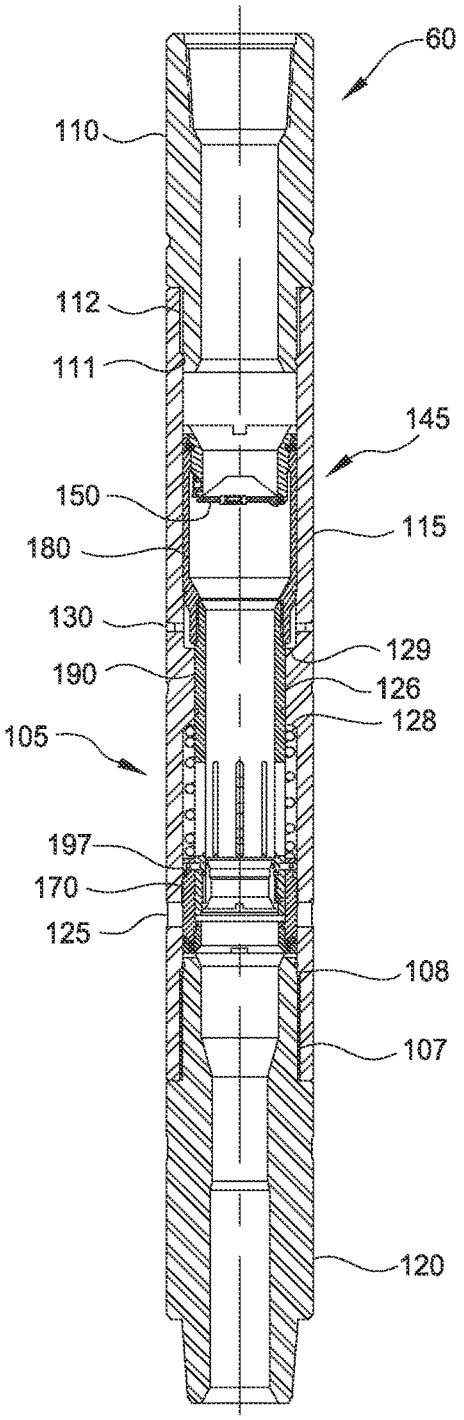
FIG. 2 is a section view of the diverter tool at the position prior to running the casing into the wellbore.
Figure 2A:
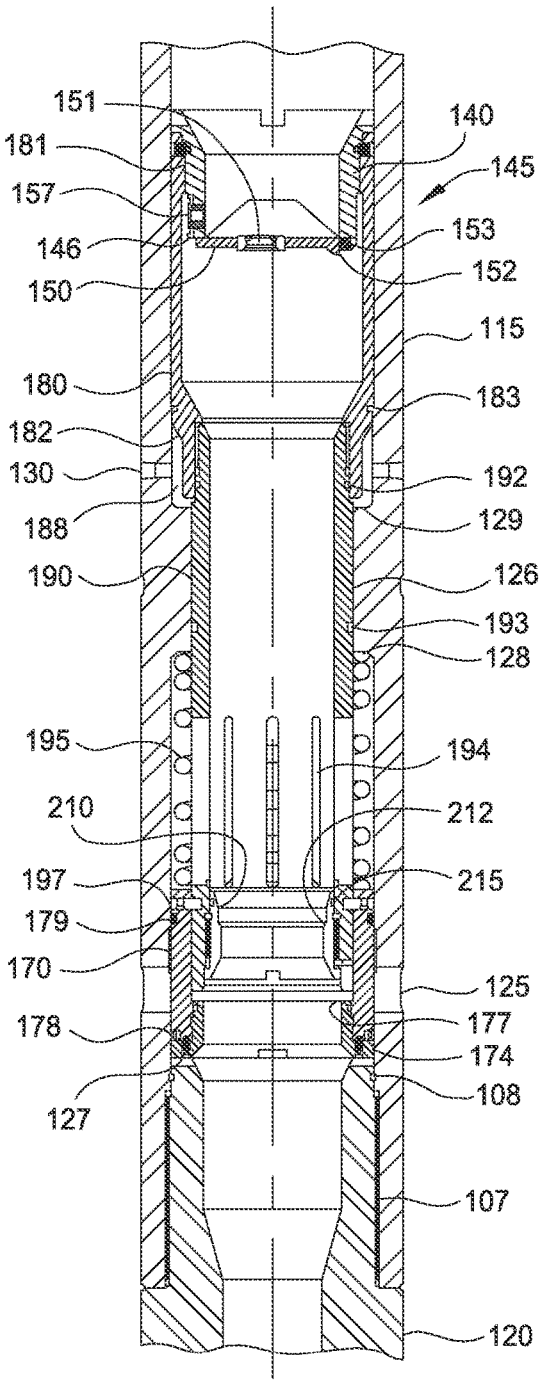
FIG. 2A is an enlarged, partial view of FIG. 2.

In FIGS. 2 and 2A, the flapper 150 is biased in the closed position against the flapper seat 146. A flapper hinge 153 hingedly connects the flapper 150 to the flapper body 140. A torsionally resilient member 152, preferably a double torsion spring, biases the flapper 150 against the flapper seat 146. The flapper 150 substantially prevents fluid flow through a portion of the bore of the body 105 and is preferably substantially perpendicular to the body 105 in the closed position. To open the flapper 150, a force must push the flapper 150 downward so that the flapper 150 pivots around the hinge 153 in a direction away from the flapper seat 146.

The flapper 150 may be curved to a shape substantially similar to the contour of the flapper body 140 when the flapper 150 is in the open position. In one embodiment, the flapper 150, when in the open position, fits against the bore of the diverter tool 60 and is curved sufficiently so that the bore through the diverter tool 60 is at least substantially unobstructed or not restricted by the presence of the flapper 150.

Referring again to FIGS. 2 and 2A, the flapper assembly 145 is connected to a surrounding flapper housing sleeve 180, such as by a threaded connection 181. As mentioned above in relation to threaded connections 107 and 112, it is also within the scope of embodiments of the present invention that the flapper assembly 145 may be connected to the flapper housing sleeve 180 by any other known connection means in lieu of the threaded connection. The flapper housing sleeve 180 is a tubular body with a longitudinal bore therethrough and resides between the port body 115. The flapper assembly 145 is located at the upper portion of the housing sleeve 180.

The flapper housing sleeve 180 has a sloped portion 182 that angles inward into the bore of the diverter tool 60. The outer diameter of the housing sleeve 180 below the sloped portion 182 is smaller than the adjacent inner diameter of the body portion 115 thereby forming an annular area 188 therebetween.

A shear sleeve 190 having a longitudinal bore therethrough is connected below the housing sleeve 180. The shear sleeve 190 extends below the inwardly extending portion 126 of the port body 115.

One or more sealing members 183 are disposed between the flapper housing sleeve 180 the port body 115, one or more sealing members 192 are disposed between the shear sleeve 190 and the flapper housing sleeve 180, and one or more sealing members 193 are disposed between the shear sleeve 190 and the port body 115 at or near the inwardly-extending portion 126 of the port body 115. The sealing members 183, 192, 193 isolate the bore of the diverter tool 60 from the annular area 188 and the wellbore (or surrounding casing) around the outside of the diverter tool 60. The pressure outside of the diverter tool 60 can communicate through the pressure ports 130 into the annular area 188 defined by the port body 115, the shear sleeve 190, the flapper housing sleeve 180, and the sealing members 183, 192, 193.

A port sleeve 170 is disposed between the port body 115 and the shear sleeve 190. The port sleeve 170 is shearably connected to the shear sleeve 190 by one or more frangible members 197, which preferably include one or more shear screws. Downward movement of the port sleeve 170 is limited by the lower body 120.

A resilient member 195 is disposed below the inwardly-extending portion 126 of the port body 115 and exterior to the shear sleeve 190. The resilient member 195 is preferably a spring. The resilient member 195 is configured to urge the port sleeve 170 against the stop shoulder 127 of the lower body 120 so that the port sleeve 170 covers the bypass ports 125 of the port body 115, as shown in FIGS. 2 and 2A.

One or more sealing members 178 and 179 are disposed between the port body 115 and the port sleeve 170 at locations above and below the bypass ports 125. The sealing members 178 and 179 act to prevent fluid from flowing out of the bore of the diverter tool 60 through the bypass ports 125 when the port sleeve 170 covers the bypass ports 125, as shown in FIG. 2A (in this position, the bypass valve is closed).

One or more slots 194 are formed through the shear sleeve 190 and are spaced about the circumference of the shear sleeve 190. The slots 194 allow debris such as mud to be removed so the debris does not impede movement of the resilient member 195.

The port sleeve 170 may include an inwardly-extending shoulder 177 which extends into the bore of the diverter tool 60. The inwardly-extending shoulder 177 is configured to halt downward movement of the shear sleeve 190 when the frangible members 197 are sheared, and the shear sleeve 190 slides relative to the port sleeve 170. In one embodiment, the inwardly-extending shoulder 177 is formed by a shoulder sleeve 174 that is attached to the shear sleeve 190. In another embodiment, inwardly-extending shoulder 177 is integral with the shear sleeve 190.

In operation, the diverter tool 60 is assembled and connected to the running string 50, preferably as shown in FIG. 1. The running tool 70 is then connected by the temporary attachment 85 to the inner diameter of the casing 80 (or liner) to be run into the wellbore 75. FIG. 2 shows the diverter tool 60 in the resting position at least substantially absent fluid flow therethrough. In this initial position, the bypass ports 125 are closed by the port sleeve 170 (biased over the bypass ports 125 by the resilient member 195), and the flapper 150 is biased closed by the spring 152.

Figure 3:
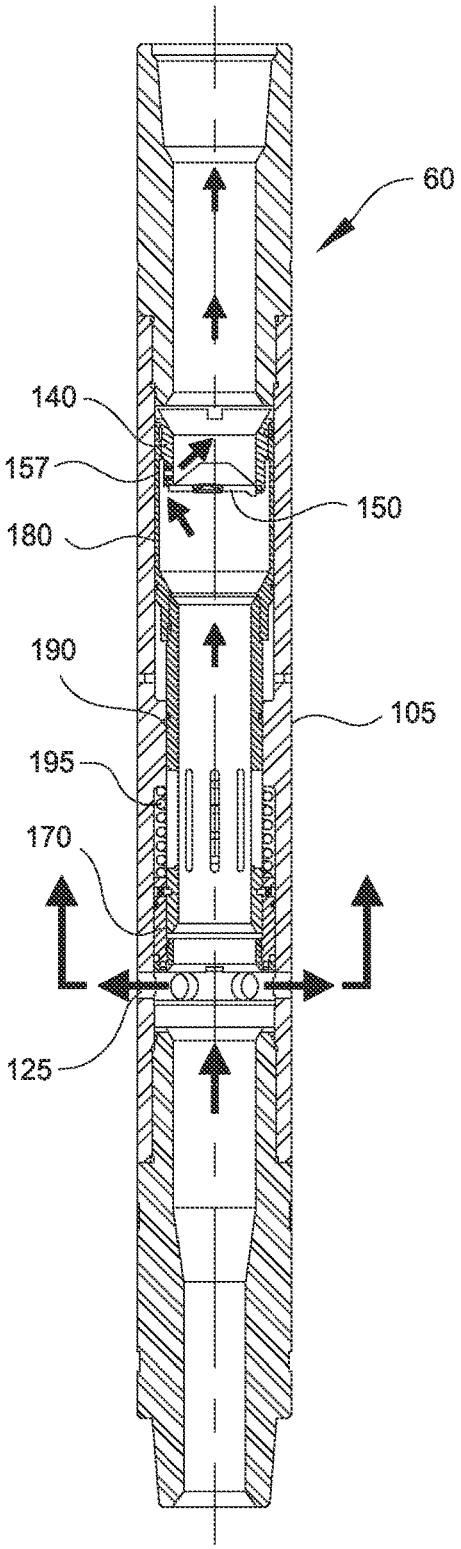
FIG. 3 is a section view of the diverter tool in position for running the casing into the wellbore.

The casing 80 is next lowered into the wellbore 75 using the running string 50. FIG. 3 shows the diverter tool 60 during running of the casing 80 into the wellbore 75. As the casing 80 is lowered into the wellbore 75, fluid from within the wellbore 75 flows upward into the casing 80, the running tool 70, the drill pipe 65, and up through the diverter tool 60. When the fluid reaches the closed flapper 150, fluid pressure builds up within the bore of the diverter tool 60 below the flapper 150. Some of the fluid may flow through the holes 157 in the flapper body 140; however, a net pressure below the flapper 150 is created because of the differential pressure between above and below the flapper 150.

When a predetermined pressure differential is reached, the fluid pressure below the flapper 150 overcomes the bias force of the resilient member 195. As a result, the pressure urges the flapper assembly 145, flapper housing sleeve 180, shear sleeve 190, and port sleeve 170 upward relative to the tool body 105. Preferably, the bias force of the resilient member 195 is overcome at a pressure differential between about 20 psi to 80 psi. Even more preferably, the bias force of the resilient member 195 is overcome at a pressure differential between about 35 psi to 55 psi. A small pressure differential is preferred so as not to damage the surrounding formation. Shifting the flapper assembly 145 and the port sleeve 170 upward relative to the tool body 105 a predetermined distance uncovers the bypass ports 125 for fluid communication. FIG. 3 shows the bypass ports 125 opened and the diverter tool 60 in position to circulate fluid through the bypass ports 125.

Opening the bypass ports 125 allows pressurized fluid flowing upward from within the wellbore 75 below to exit through the bypass ports 125 rather than surging upward through the running string 50 onto the rig floor. Furthermore, opening the bypass ports 125 relieves pressure from within the wellbore 75, thereby preventing damage to the formation.

Figure 4:
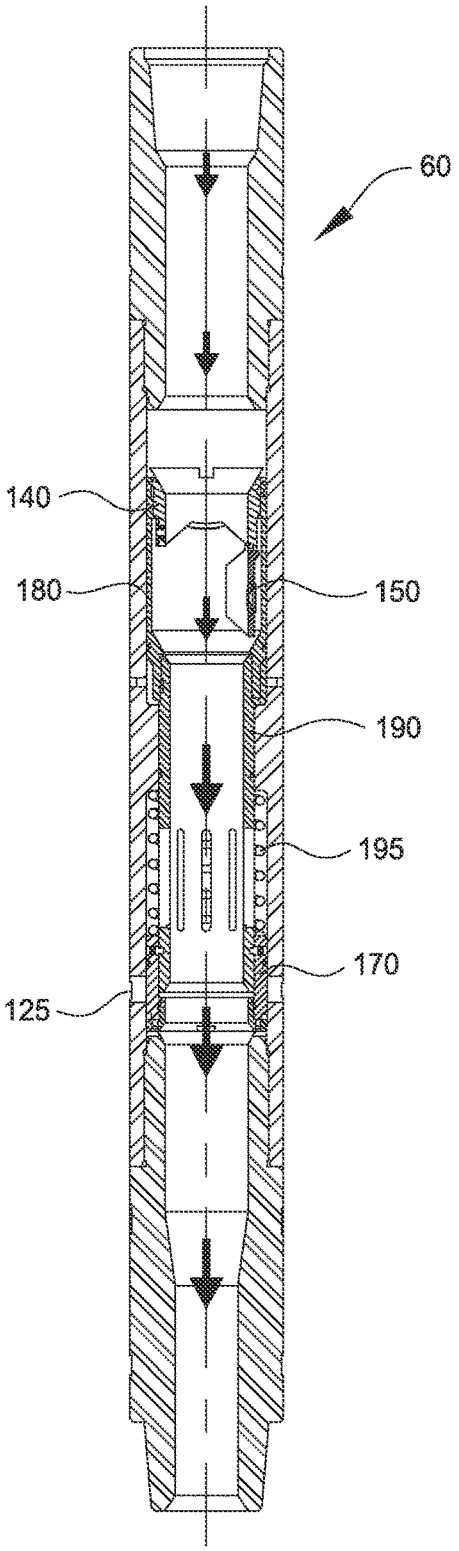
FIG. 4 is a section view of the diverter tool in the position for circulating fluid down through the casing.

If at any point during the running of the casing 80 into the wellbore 75 an obstruction to running the casing 80 is reached, the diverter tool 60 may be moved to the circulation position to circulate fluid from the surface 35 to wash out the obstruction, as shown in FIG. 4. In one embodiment, the downward movement of the diverter tool 60 is stopped or slowed to reduce the flow of fluid into the diverter tool 60, thereby allowing the resilient member 195 to close the bypass ports 125. Fluid may then optionally be introduced from the surface 35 downward through the running string 50 to perform a circulating operation. After it is determined that the obstruction is sufficiently removed, the diverter tool 60 can be returned to the run-in position by continuing to lower the casing 80 further into the wellbore 75. Thus, the bypass ports 125 always remain closed unless fluid is flowing upward through the diverter tool 60 and/or the resultant force from differential pressure acting on the flapper 150 exceeds the force of the resilient member 195 acting to close the port sleeve 170.

When circulating fluid down through the running string 50, pressurized fluid flowing downward overcomes the bias force of the resilient member 152 of the flapper 150, thus rotating the flapper 150 around the flapper hinge 153 to the open position. In this position, the flapper 150 is substantially flush with and substantially parallel to the flapper housing sleeve 180. Also, the bore of the diverter tool 60 is not restricted by the flapper 150 due to the curved design of the flapper 150 and is not restricted by any other tools necessary to operate the flapper 150. Although the curved design of the flapper 150 is used in embodiments described herein, it is contemplated that any shape or design of flapper or other one-way valve may be used in embodiments of the present invention.

In one embodiment, the cyclic function of the opening and closing of the bypass ports 125 is automatic and without the need to vary from ordinary casing running and fluid circulating operations. Because the diverter tool 60 is naturally biased toward a closed bypass ports 125 position, it is not necessary to restrict the inner diameter of the diverter tool 60 by providing a ball or dart seat therein, drop a device into the wellbore 75, pump a device into the diverter tool 60, manipulate the diverter tool 60, or reach a certain depth within the wellbore 75 to cycle the diverter tool 60 closed. The naturally closed state of the diverter tool 60 without any manipulation makes the diverter tool 60 especially desirable from a wellbore control perspective.

Figure 6:
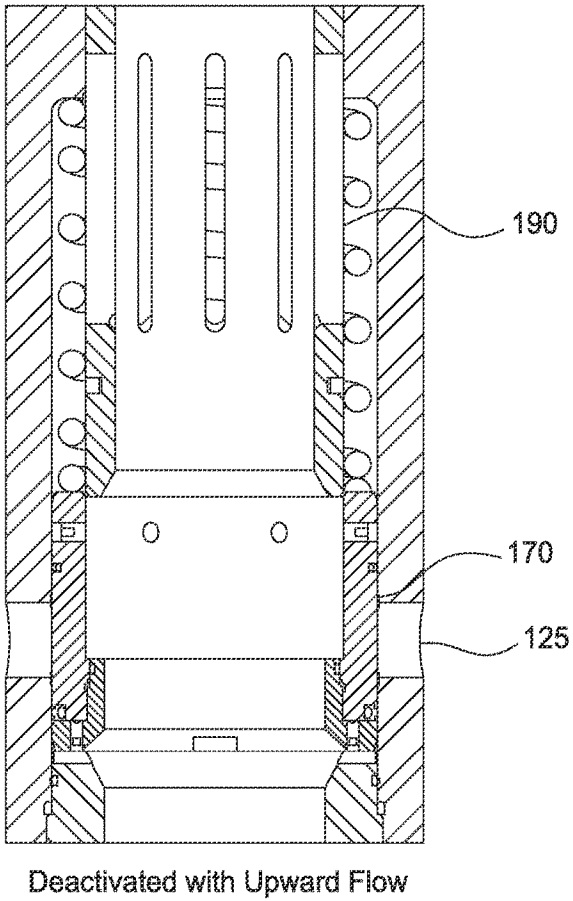
FIG. 6 is a section view of the diverter tool in the deactivated position while fluid is flowing upward.
Figure 5:
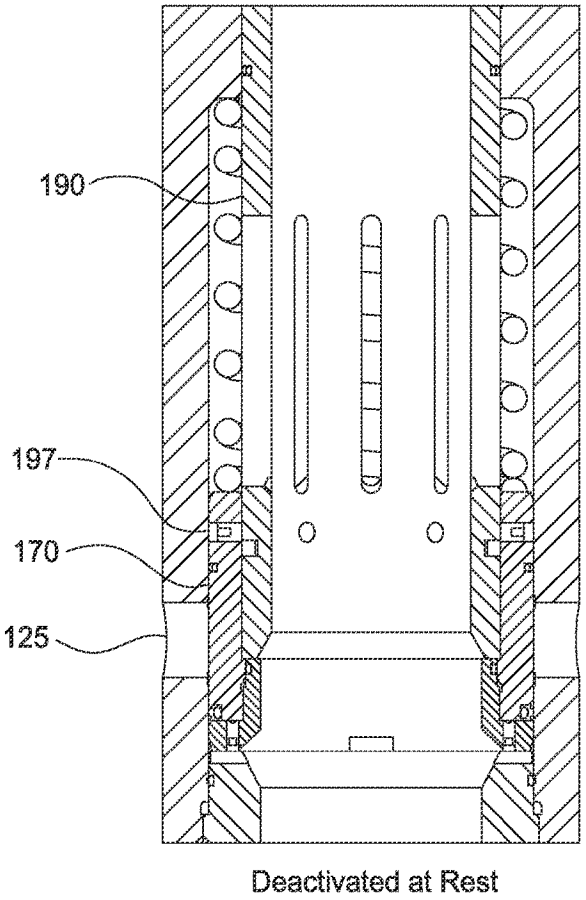
FIG. 5 is a section view of the diverter tool in the deactivated position.

If desired, the cyclic function of the diverter tool 60 (the opening and closing of the bypass ports 125) may be deactivated by the occurrence of a pressure increase within the running string 50. FIG. 5 shows the diverter tool 60 in the deactivated position wherein the cyclic opening and closing function of the bypass ports 125 is disabled. The cyclic function is disabled generally by uncoupling the flapper assembly 145 and the shear sleeve 190 from the port sleeve 170. Specifically, a pressure event inside the diverter tool 60 which causes a pressure differential between the pressure within the diverter tool 60 and the pressure outside the diverter tool 60 shears the frangible member 197 so that the port sleeve 170 is uncoupled from the shear sleeve 190, which is threadedly connected to the flapper housing sleeve 180 and flapper assembly 145. After uncoupling, the flapper assembly 145 and the shear sleeve 190 are slidable relative to the port sleeve 170. As a result, the bias force of the resilient member 195 is unopposed, which allows the biasing force of the resilient member 195 to retain the port sleeve 170 in the closed position. In the deactivated state, fluid pressure from either above or below the diverter tool 60 would only move the flapper assembly 145, the flapper housing sleeve 180, and the shear sleeve 190, but would not affect the closed state of the bypass ports 125. FIG. 6 shows the diverter tool 60 in an deactivated state and the fluid is flowing upward. As shown, the shear sleeve 190 has moved upward relative to the port sleeve 170.

In one embodiment, pressure is supplied from the surface to deactivate the diverter tool 60. The supplied pressure acts on the interior surface of the sloped portion 182 of the housing sleeve 180, while the wellbore pressure communicated into the annular area 188 via the pressure ports 130 acts on the exterior surface of the sloped portion 182. The wellbore pressure acts upward on the lower end of the flapper housing sleeve 180 as well as the sloped lower surface 182 of the flapper housing sleeve 180, while the pressure within the bore of the diverter tool 60 acts downward on the sloped upper surface 200 of the flapper housing sleeve 180. When the pressure acting downward becomes greater than the pressure acting upward on the sloped portion 182 of the flapper housing sleeve 180, the port sleeve 170 is biased downward over the bypass ports 125 by the resilient member 195. At a predetermined pressure differential between the bore pressure and the wellbore pressure, the frangible member 197 is sheared so that the port sleeve 170 is decoupled from the shear sleeve 190. In this manner, the diverter tool 60 is converted to the deactivated position shown in FIG. 5. In the deactivated position, the bypass ports 125 remain closed independent of fluid flow from the wellbore 75 through the diverter tool 60. It is contemplated that other suitable pressure events may be used to deactivate the diverter tool 60. Exemplary suitable pressure events include pressuring up during the cementing operation; increasing the pressure within the diverter tool 60 to activate a gripping assembly such as one or more slips (e.g., a hydraulic liner hanger) to hang the casing 80; increasing the pressure within the diverter tool 60 to release subsea plugs; and increasing the pressure within the diverter tool 60 to shear the float valve or check valve bypass tubing. Also, the pressure event may be caused by the functional operation of any tool or mechanism located within the bore of the running string or casing, located below the bypass valve, which involves an increase in pressure within the bore of the diverter tool 60. Exemplary tools which may be utilized to cause the pressure event include, but are not limited to, a plug indicator, float collar, float shoe, subsea running tool, ball seat, landing seat, landing collar, or any restriction within the bore of the diverter tool 60.

Embodiments of the diverter tool include a secondary closing apparatus and method. In one embodiment, the diverter tool may be closed using a pump down closure device. Referring back to FIG. 2A, the diverter tool 60 may optionally include a closure sleeve 210 having a seat 212 attached to the lower portion of the shear sleeve 190. The closure seat 212 is adapted to receive the closure device. A sealing member 215 such as an o-ring is disposed between the closure sleeve 210 and the shear sleeve 190.

FIG. 7 illustrates an exemplary closure device 220. The closure device 220 includes a tubular body 225 having a bore therethrough. An upper guide 226 and a lower guide 227 may be attached to each end of the tubular body 225. In another embodiment, one or both of the guides 226, 227 may be integral with the tubular body 225. Sealing members 216, 217 may be provided between the guides 226, 227 and the tubular body 225 to prevent fluid communication. A sealing member 236 is disposed on the exterior of the lower guide 227 for sealing engagement with the diverter tool 60. A rupture member 230 is disposed in the bore of the tubular body 225 to selectively block fluid communication through the bore. In this embodiment, the rupture member 230, such as a rupture disk, is disposed at a lower end of the bore. In one embodiment, the rupture disk may have a burst rating from about 150 psi to about 650 psi, or from about 250 psi to about 500 psi. In one embodiment, the rupture member 230 is made from a ceramic material. The tubular body 225 includes an enlarged portion 235 defining a shoulder for engaging the seat 212 of the closure sleeve 210. A sealing member 232 is disposed on the enlarged portion 235 for sealing engagement with the seat 212. In another embodiment, one or more sealing members 232 may be disposed on the seat 212, the enlarged portion 235, or both.

One or more fins 241-246 are disposed on the exterior of the tubular body 225. The fins 241-246 are configured to sealing engage the wall surrounding the closure device 220 as it travels down the bore of the running string 50, casing string 80, or the diverter tool 60. In one embodiment, the closure device 220 may have a plurality of fins 241-246 that have different outer diameter sizes. As shown in FIG. 7, the closure device 220 includes a first fin 241 configured for sealing engagement with the surrounding wall as the closure device 220 travels downward. In this respect, the first fin 241 has a sufficiently sized outer diameter that is engageable with the largest inner diameter the closure device 220 may encounter during its descent. Also, the first fin 241 is sufficiently flexible so that the closure device 220 may travel through smaller restrictions. In one embodiment, the enlarged portion 235 has an outer diameter that is larger than the smallest restriction through which a fin 241-246 may pass. The closure device 220 may optionally include additional fins 242-246. As shown in FIG. 7, the closure device 220 includes six fins 241-246, although the closure device 220 may be equipped with two, three, four, five, or more fins. Two of the fins 243, 245 have the same outer diameter, which is larger than the outer diameter of the other three fins 242, 244, and 246. The outer diameters of these additional fins 242-246 may be configured for sealing engagement with the inner diameter of different sections of the diverter tool 60. The fins 241-246 may be made of polymer such as polyurethane or any other suitable elastomer, which may be chosen based on the well conditions. To facilitate assembly, one or more fins 241-246 may be attached to an optional spacer sleeve 239, which is disposed around the tubular body 225. In this embodiment, fins 241-243 are attached to a first spacer sleeve 239, and fins 244-246 are attached to a second spacer sleeve 239. The spacer sleeves 239 may be disposed between the enlarged portion 235 and one of the guides 226, 227. In one embodiment, the enlarged portion 235 has an outer diameter larger than an outer diameter of the spacer sleeves 239. Alternatively, one or more fins 241-246 may be attached directly to the tubular body 225. For example, fins 241-243 may be molded directly onto the tubular body 225. In another embodiment, a supporting material such as a foam may be provided behind the fins 241-246 to support the polymeric fins.

Embodiments of the closure device 220 may be used to close the diverter tool 60. In operation, the closure device 220 is released into the running string 50 and/or the casing 80. During the descent, at least one of the fins 241-246 of the closure device 220 sealingly contacts the surrounding wall; for example, the running pipe 55. Because the fins 241-246 and the rupture disk 230 prevent fluid from flowing around the closure device 220, fluid may be supplied behind the closure device 220 to urge the closure device 220 forward. In this respect, the closure device 220 may be used to close the diverter tool 60 in a wellbore positioned at any angle, including vertical and horizontal wellbores. The closure device 220 will open the flapper 150 and pass through the flapper assembly 145.

Figure 8:
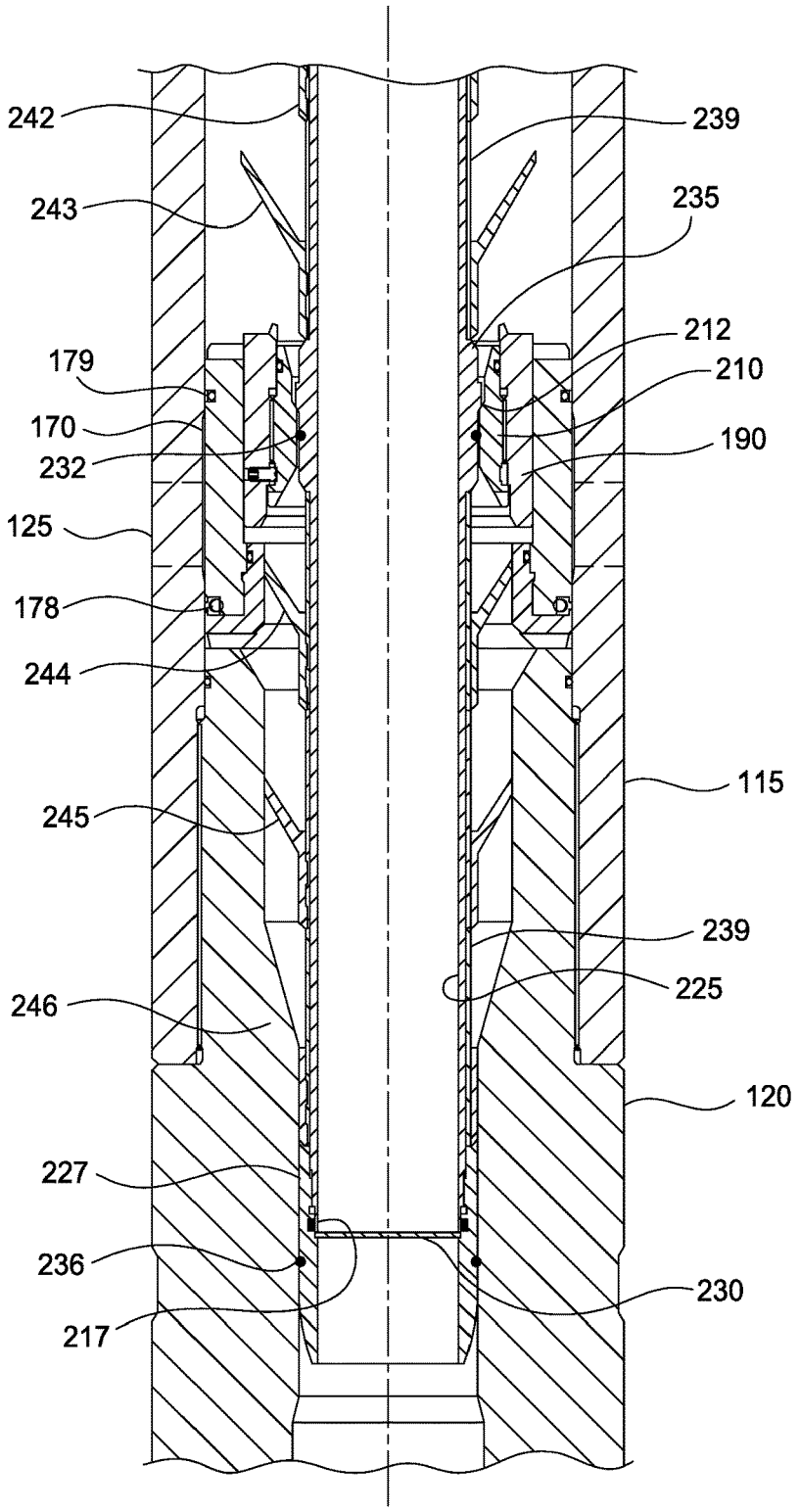
FIG. 8 is a partial, cross-sectional view of the closure device of FIG. 7 disposed in an exemplary diverter tool.

The closure device 220 will descend until the enlarged portion 235 lands in the seat 212 of the closure sleeve 210, as shown in FIG. 8. In this position, fluid behind the closure device 220 will generate a downward force that is transferred from the enlarged portion 235 to the closure sleeve 210, which then transfers the force to the shear sleeve 190. In turn, the force is transferred to the inwardly-extending shoulder 177 of the port sleeve 170, thereby urging port sleeve 170 downward to close the bypass ports 125. Additionally, it can be seen that the sealing member 232 is disposed between the enlarged portion and the closure sleeve 210, and the sealing member 236 is disposed between the closure device 220 and the inner surface of the lower body 120. Also, fins 245 and 246 sealingly engage the inner surface of the lower body 120, and fins 242-244 sealingly engage the inner surface of the shear sleeve 190. The fin 241 may engage the inner surface of the housing sleeve 180 and/or the shear sleeve 190. The top of the closure device 220 may be disposed below the flapper 150, so that the flapper 150 is allowed to open or close. In another embodiment, the closure device 220 may be sufficiently long so that it retains the flapper 150 in the open position.

After closing the bypass ports 125, fluid pressure may be supplied to break the rupture disk 230 to re-establish fluid communication through the diverter tool 60. In this manner, a closure device may used to close the diverter tool 60 even if the diverter tool 60 is located in a deviated wellbore such as a horizontal wellbore. Thereafter, the diverter tool 60 may optionally be deactivated as described above.

In one embodiment, a method of closing a tool in a wellbore includes releasing a closure device into the wellbore, wherein the closure device includes a fin sealingly engaged with a surrounding wall; supplying fluid behind the closure device to urge the closure device downward; landing the closure device in the tool; and closing the tool.

In another embodiment, a method of closing a tool in a wellbore includes releasing a closure device into the wellbore, wherein the closure device includes a fin; supplying fluid behind the closure device to move the closure device; landing the closure device in a seat of the tool; moving a port sleeve coupled to the seat to close the tool; and decoupling the port sleeve from the seat.

In one or more of the embodiments described herein, the method includes opening fluid communication through the closure device.

In one or more of the embodiments described herein, opening fluid communication comprises breaking a rupture member disposed in a bore of the closure device.

In one or more of the embodiments described herein, the closure device includes a tubular body, In one or more of the embodiments described herein, the closure device includes a rupture member disposed in a bore of the tubular body to block fluid communication therethrough.

In one or more of the embodiments described herein, the fin is disposed around the tubular body.

In one or more of the embodiments described herein, the method includes sealingly engaging the closure device to the tool after landing in the tool.

In one or more of the embodiments described herein, the closure device sealingly engages the tool at two different axially spaced locations.

In one or more of the embodiments described herein, closing the tool includes moving a port sleeve of the tool.

In one or more of the embodiments described herein, the method includes coupling the closure device to the port sleeve after landing in the tool; and wherein moving the port sleeve includes increasing pressure behind the closure device.

In one or more of the embodiments described herein, the tool is a diverter tool.

In another embodiment, a diverter tool assembly includes a tool body having bore therethrough; a flapper for controlling fluid flow through the bore; a port in the tool body in fluid communication with the bore; an axially movable port sleeve for controlling fluid communication through the port; a seat coupled to the axially movable sleeve; and a closure device configured to engage the seat.

In one or more of the embodiments described herein, the diverter tool includes a shear sleeve releasably coupled to the port sleeve.

In one or more of the embodiments described herein, the flapper is coupled to a flapper body having an aperture for fluid communication with the bore.

In another embodiment, a closure device includes a tubular body having an enlarged outer portion and a bore therethrough; a first fin disposed around the tubular body; and a rupturable member disposed in the bore to block fluid communication the bore.

In one or more of the embodiments described herein, the closure device includes a second fin having an outer diameter smaller than the first fin.

In one or more of the embodiments described herein, the enlarged portion has an outer diameter that is larger than a smallest restriction through which the first fin can traverse.

In one or more of the embodiments described herein, the closure device includes a sealing member disposed on an exterior of the enlarged outer portion.

In one or more of the embodiments described herein, the closure device includes a sealing member disposed on an exterior of the tubular body.

In another embodiment, a method of running a tubular in a wellbore includes lowering the tubular equipped with a diverter tool; shifting a port sleeve to open a port in response to a pressure increase in the diverter tool; releasing a closure device into the wellbore, wherein the closure device includes a fin; supplying fluid behind the closure device to urge the closure device downward; landing the closure device in the diverter tool; and closing the port.

In one or more of the embodiments described herein, the method includes opening fluid communication through the closure device.

In one or more of the embodiments described herein, opening fluid communication comprises breaking a rupture member disposed in a bore of the closure device.

In one or more of the embodiments described herein, the method includes sealingly engaging the closure device to the diverter tool after landing in the diverter tool.

In one or more of the embodiments described herein, the closure device sealingly engages the diverter tool at two different axially spaced locations.

In one or more of the embodiments described herein, the closure device lands in a seat coupled to the port sleeve.

In one or more of the embodiments described herein, the method includes deactivating the diverter tool after closing the port.

In one or more of the embodiments described herein, deactivating the diverter tool includes decoupling the seat from the port sleeve.

In one or more of the embodiments described herein, the fin is sealingly engaged with a surrounding wall.

In one or more of the embodiments described herein, the surround wall is a wall of a tubular, such as a pipe.

In one or more of the embodiments described herein, the tubular may be selected from casing, liner, riser, and other suitable wellbore tubulars.

In the above description, the "upper," "lower," "upward," "downward," and other relative terms are merely used herein to provide a reference for actions performed and relative locations of portions of the apparatus. Therefore, other directional movements and relative locations are contemplated for use in embodiments of the present invention, such as in a horizontal, lateral, or directionally-drilled wellbore.

The above description primarily relates to embodiments of the present invention used in cased wellbores. However, it is contemplated that in other embodiments of the present invention, the wellbore may be open hole and uncased, for example in deep sea applications. In deep sea applications, the diverter tool 60 may be utilized to divert wellbore fluids into a sub-sea riser pipe which extends between the sea floor and the drilling rig at the surface of the body of water.

While the foregoing is directed to embodiments of the present invention, other and further embodiments of the invention may be devised without departing from the basic scope thereof, and the scope thereof is determined by the claims that follow.

The invention claimed is:

1. A method of closing a tool in a wellbore, comprising:

releasing a closure device into the wellbore, wherein the closure device includes a first fin, a second fin, and an enlarged outer portion disposed between the first fin and the second fin;

supplying fluid behind the closure device to move the closure device;

landing the closure device in a seat of the tool, wherein the enlarged outer portion is engaged with the tool;

moving a port sleeve coupled to the seat to close the tool; and decoupling the port sleeve from the seat.

2. The method of claim 1, further comprising opening fluid communication through the closure device.

3. The method of claim 2, wherein opening fluid communication comprises breaking a rupture member disposed in a bore of the closure device.

4. The method of claim 1, wherein the closure device comprises a tubular body.

5. The method of claim 4, wherein the closure device further comprises:

a rupture member disposed in a bore of the tubular body to block fluid communication therethrough.

6. The method of claim 5, wherein the first and second fins are disposed around the tubular body.

7. The method of claim 4, wherein the tubular body is disposed in a spacer sleeve and the first and second fins are attached to the spacer sleeve.

8. The method of claim 1, further comprising sealingly engaging the closure device to the tool after landing in the tool.

9. The method of claim 8, wherein the closure device sealingly engages the tool at two different axially spaced locations.

10. The method of claim 9, wherein moving the port sleeve comprises increasing pressure behind the closure device.

11. The method of claim 1, wherein decoupling the port sleeve from the seat comprises shearing a frangible member, wherein the frangible member connects the seat and port sleeve.

12. A closure device, comprising:

a tubular body having an enlarged outer portion for engaging a seat of a downhole tool and a bore therethrough;

a first fin disposed around the tubular body below the enlarged outer portion;

a second fin disposed around the tubular body and above the enlarged outer portion; and a rupturable member disposed in the bore to block fluid communication through the bore.

13. The closure device of claim 12, further comprising a third fin having an outer diameter smaller than the first fin.

14. The closure device of claim 12, wherein the enlarged portion has an outer diameter that is larger than a smallest restriction through which the first fin can traverse.

15. The closure device of claim 12, further comprising a sealing member disposed on an exterior of the enlarged outer portion.

16. The closure device of claim 15, further comprising another sealing member disposed on an exterior of the tubular body, wherein the first fin is disposed between the another sealing member and the sealing member disposed on the exterior of the enlarged outer portion.

17. The closure device of claim 12, further comprising a sealing member disposed on an exterior of the tubular body.

18. A method of running casing in a wellbore, comprising:

lowering a casing equipped with a diverter tool;

shifting a port sleeve to open a port in response to a pressure increase in the diverter tool;

releasing a closure device into the wellbore, wherein the closure device includes a first fin, a second fin, and an enlarged outer portion disposed between the first fin and the second fin;

supplying fluid behind the closure device to move the closure device;

landing the closure device in the diverter tool; and closing the port.

19. The method of claim 18, further comprising opening fluid communication through the closure device.

20. The method of claim 19, wherein opening fluid communication comprises breaking a rupture member disposed in a bore of the closure device.

21. The method of claim 18, further comprising sealingly engaging the closure device to the diverter tool after landing in the diverter tool.

22. The method of claim 21, wherein the closure device sealingly engages the diverter tool at two different axially spaced locations.

23. The method of claim 18, wherein the closure device lands in a seat coupled to the port sleeve.

24. The method of claim 23, further comprising deactivating the diverter tool after closing the port.

25. The method of claim 24, wherein deactivating the diverter tool comprises decoupling the seat from the port sleeve.

* * * * *